United States Patent [19]

Sano et al.

[11] 4,251,904

[45] Feb. 24, 1981

[54] YARN TREATING APPARATUS

[75] Inventors: Takao Sano; Masafumi Ogasawara, both of Ohtsu, Japan

[73] Assignee: Toray Industries, Inc., Tokyo, Japan

[21] Appl. No.: 89,969

[22] Filed: Oct. 31, 1979

[30] Foreign Application Priority Data

Nov. 8, 1978 [JP] Japan ..... 53-136792
Nov. 8, 1978 [JP] Japan ..... 53-136793

[51] Int. Cl.[3] ..... D02J 1/08; D02G 1/16

[52] U.S. Cl. ..... 28/274; 28/271; 28/276

[58] Field of Search ..... 28/271–276; 57/350, 351

[56] References Cited

U.S. PATENT DOCUMENTS

| | | | |
|---|---|---|---|
| 2,985,995 | 5/1961 | Bunting, Jr. et al. | 28/276 X |
| 3,115,691 | 12/1963 | Bunting, Jr. et al. | 28/274 |
| 3,262,179 | 7/1966 | Sparling | 28/274 |
| 3,448,501 | 6/1969 | Buzano | 28/271 |
| 3,525,133 | 8/1970 | Psaras | 28/276 |
| 4,069,565 | 1/1978 | Negishi et al. | 28/274 X |
| 4,115,988 | 9/1978 | Nakagawa et al. | 28/274 X |

*Primary Examiner*—John Petrakes
*Attorney, Agent, or Firm*—Miller & Prestia

[57] ABSTRACT

Yarn treating apparatus having a yarn treating chamber formed therein which is surrounded by a first wall lying on a flat plane extending axially and a second wall connected to the sides of the first wall and constituted with a plurality of flat surfaces, a curved surface, or a plurality of curved surfaces or a combination thereof. The second wall is symmetrical with respect to an imaginary standard plane, perpendicular to the first wall and axially extending. A plurality of fluid jet nozzles is formed on the second wall, and fluid jet flows symmetrical with the imaginary standard plane are ejected from the fluid jet nozzles and meet with each other on or above the first wall before they reach it or on the first wall while they blow towards the first wall.

19 Claims, 20 Drawing Figures

YARN TREATING APPARATUS

TECHNICAL FIELD TO WHICH THE INVENTION RELATES

The present invention relates to an apparatus wherein fluid jet is ejected to a running multifilament yarn so that filaments constituting the running yarn are intermingled with each other by means of energy of the fluid jet and so that the coherency of the yarn is increased. More specifically, the present invention relates to an improvement of a yarn treating apparatus comprising a shell body which has: a yarn treating chamber formed therein; an entrance of the chamber formed at its front end; an exit of the chamber formed at its rear end; and jet nozzles, for ejecting fluid jet, formed on a peripheral wall of the chamber, which chamber extends from the entrance to the exit.

BACKGROUND ART OF THE INVENTION

Well known are yarn treating technologies wherein a yarn is subjected to a fluid jet, in general an air jet. The technologies are classified into three types: a first technology wherein filaments constituting a yarn are interlaced with each other so that the yarn is provided with a high coherency; a second technology wherein loops or false-twists are imparted into filaments constituting a yarn so that the yarn is provided with a high volume; and a third technology wherein twist torque is imparted to a yarn so that the yarn is provided with high twists.

The present invention relates to an apparatus which is utilized for yarn treatment belonging to the above-mentioned first technology which hereinbelow will be referred to as "interlacing".

Many apparatus for interlacing are disclosed in prior arts, for example United States Pat. No. 2,985,995, British Pat. No. 1,301,500 and Japanese Patent Publication No. 18056/72.

The inventors of the present invention conducted a careful investigation regarding behaviors of a yarn and filaments constituting the yarn during the interlacing operation. As a result, they found, that in order to obtain an interlaced yarn which is uniformly interlaced at a high level, the unidirectional and continuous rotation of the yarn during the interlacing operation is required to be maintained as minimal as possible and that the yarn is required to be subjected to a stable, periodical and sufficient opening operation.

Based on the result, they then conducted research for actual design of an interlacing apparatus which can satisfy the requirements. As a result, to minimize the unidirectional and continuous rotational movement of a yarn, it is confirmed that the shape of a peripheral wall of an interlacing chamber, which wall extends along the yarn passage, must be so selected that the unidirectional and continuous rotational movement of the yarn does not occur. It is also confirmed that the location and direction of a fluid jet nozzle must be so selected that the yarn does not produce a unidirectional and continuous rotation when it is subjected to a movement of the fluid jet after the fluid jet ejected from the fluid jet nozzle has impinged upon the yarn. Similarly, to impart a periodic and sufficient opening operation to the yarn, it is confirmed that a surface to which the yarn is periodically pressed, so as to be open fully, must be formed on a part of the peripheral wall of the interlacing chamber. Furthermore, it is confirmed that, to decrease the unidirectional and continuous rotational movement of the yarn in the interlacing chamber and to maintain the periodical and sufficient opening operation of the yarn, it is preferable that the peripheral wall of the interlacing chamber which extends along the axis of the chamber is enclosed. When a string-up slit for introducing a yarn to the interlacing chamber upon the commencement of the yarn treatment or for discharging the yarn from the interlacing chamber upon the stoppage of the yarn treatment is formed on the interlacing chamber, the string-up slit must be formed at a carefully selected position so that stability is maintained.

SUMMARY OF THE INVENTION

An object of the present invention is to provide an interlacing apparatus which produces an interlaced yarn being interlaced more highly and more uniformly than that produced by a conventional apparatus when the same amount of fluid is consumed.

Another object of the present invention is to provide an interlacing apparatus in which smaller amount of fluid is consumed than in a conventional interlacing apparatus when a yarn is interlaced at the same level.

A still further object of the present invention is to provide an interlacing apparatus which is simple in construction and easy to manufacture and assemble and which can be maintained easily.

The yarn treating apparatus of the present invention comprises a shell body which has: a yarn treating chamber formed therein; an entrance of the chamber formed at its front end; an exit of the chamber formed at its rear end; and jet nozzles for ejecting fluid jet formed on a peripheral wall of the chamber, which wall extends from the entrance to the exit. The apparatus is characterized in that the peripheral wall of the chamber includes: a first wall which lies on a plane extending from the entrance to the exit along the axis of the chamber and which has a predetermined width in a direction perpendicular to the axis; and a second wall, the sides of which are connected to the widthwise sides of the first wall so that the chamber is enclosed with the first and second walls except for the string-up slit if it is provided. The apparatus is further characterized in that the second wall is symmetrical with respect to an imaginary standard plane which passes through the center of the width on the first wall in a direction perpendicular to the first wall and which extends along the axis of the chamber. The apparatus is further characterized in that at least two fluid jet nozzles are formed on the second wall and are symmetrical with each other with respect to the imaginary standard plane and in that they are so constructed that fluid jet flows ejected therefrom are directed to the first wall and are symmetrical with each other with respect to the imaginary standard plane and meet with each other at a position above the first wall or on the first wall. The apparatus is still further characterized in that the fluid jet nozzles are communicated with one or more passages for introducing fluid which are formed in the shell body and which are open to the outside of the shell body.

In the yarn treating apparatus of the present invention, the second wall may be constructed with a plurality of flat surfaces extending along the axis so that the cross section of the chamber taken along a plane perpendicular to the axis may have a polygonal shape, for example a triangular shape, a four-cornered shape or a pentagonal shape, and so that the polygonal shape is symmetrical with respect to the imaginary standard plane. The second wall may be constructed with a combination of at least one flat surface and at least one curved surface, or a combination of a plurality of curved surfaces. Alternatively, the first wall may have a chord section, and the second wall may have an arch section, preferably an arc section, the ends of which are connected to the ends of the chord section, so that the chamber forms a semicircular cross section and so that the semicircular cross section is symmetrical with respect to the imaginary standard plane. The apparatus having a chamber formed in one of such cross sections is preferable for preventing a unidirectional and continuous rotation of a yarn and for imparting a periodic, stable and sufficient opening operation to the yarn. The cross sectional shape of the chamber may be selected in accordance with the yarn treating conditions, such as a yarn delivering speed, tension in the yarn, a total denier of the yarn, the number of the filaments, a filament denier or a material of the filament.

In an embodiment of the present invention which is most available, the fluid jet nozzles are so arranged that an imaginary plane on which the fluid jet nozzles lie intersects with the first wall forming a right angle therebetween. In another embodiment, wherein a large amount of fluid is utilized, the fluid jet nozzles are so arranged that an imaginary plane on which the fluid jet nozzles lie intersects with the first wall forming an acute angle therebetween. According to the latter embodiment, stability of the fluid motion within the chamber is enhanced.

As will be explained with reference to a further embodiment, in addition to the entrance and exit for delivering a yarn to be treated, it is preferable that a string-up slit for introducing a continuous yarn to the chamber upon the commencement of the yarn treatment and for discharging the continuous yarn from the chamber upon the stoppage of the yarn treatment is formed on the shell body, so that the yarn can be handle easily upon the commencement and stoppage of the yarn treatment. In this case the string-up slit should be formed on the second wall along the imaginary standard plane. If the string-up slit is formed otherwise, the stability of the yarn movement during the yarn treatment may be decreased or the running yarn may be expelled to the outside of the shell body through the string-up slit while the yarn is being treated. It is also preferable that the portion of the string-up slit which opens to the chamber is spread out so that the yarn can be easily discharged from the chamber.

As illustrated in a still further embodiment of the present invention, to facilitate the design, manufacture, assembly and disassembly of the apparatus, it is preferable that the shell body comprises: a first wall piece on which the first wall is formed; and at least two second wall pieces on which the second wall is formed, and that the first and second wall pieces are detachably assembled to form the chamber. In this case, it is desirable that the corresponding end surfaces of a pair of adjacent second wall pieces of the at least two second pieces are assembled apart from each other to form a small distance therebetween as necessary which is utilized as the string-up slit for introducing and discharging yarn.

In an apparatus of the present invention it is preferable that the first wall is made of ceramic which is durable against abrasion and the second wall is made of metal, such as brass, steel, or stainless steel, which is easy to manufacture precisely since the abrasion of the first wall because of the yarn contact and fluid contact does not occur easily and since the fluid jet nozzles can be formed precisely on the second wall. Similarly, it is also preferable that the regions on the second wall between portions where the fluid jet nozzles are located and portions where the second wall intersects with the first wall are made of ceramic.

As will be illustrated hereinafter with reference to an embodiment of the present invention, it is desirable that the apparatus further includes a ceramic piece which is detachable from the shell body and which has the first wall thereon, so that the chamber of the apparatus can readily be repaired. In a special embodiment of the present invention, a ceramic piece detachable from the shell body has: a first wall formed thereon; and the second wall regions between the portions where the fluid jet nozzles are located and portions where the second wall intersects with the first wall which regions are formed adjacent to the widthwise ends of the first wall. In these embodiments, it is preferable that at least one of the surfaces of the entrance and the exit of the shell body is axially spaced a distance from the corresponding surface on the ceramic piece to form a step therebetween, so that the yarn does not enter into small gaps formed between the engaging surfaces of the shell body and the ceramic piece and, as a result, the yarn can be handled easily.

In the present invention, when the assembling system is applied to the shell body and a ceramic piece is used in the system, it is preferable that the ceramic piece is supported by an elastic member, such as an O-ring made of natural or synthetic rubber, and is assembled in the shell body, so that deflections caused in the engaging surfaces between the aseembled members because of the tolerance for manufacturing the same can be absorbed by the elastic member. In other words, the design, the manufacture and the assembly of the apparatus according to the present invention are highly increased.

BRIEF DESCRIPTION OF THE DRAWINGS

Some embodiments of the present invention will now be explained with reference to the accompanying drawings, wherein.

DESCRIPTION OF THE PREFERRED EMBODIMENTS OF THE INVENTION

Figure 1:
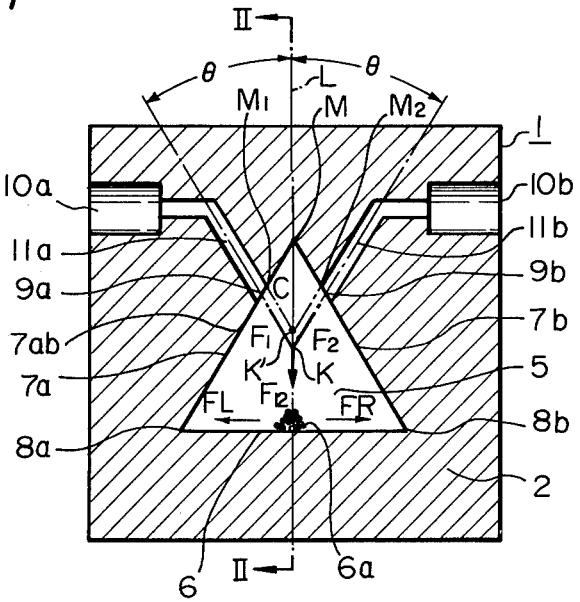
FIG. 1 is a cross sectional elevational view of a first embodimdent of the present invention, which view is taken along a plane perpendicular to the axis of the embodiment.
Figure 2:
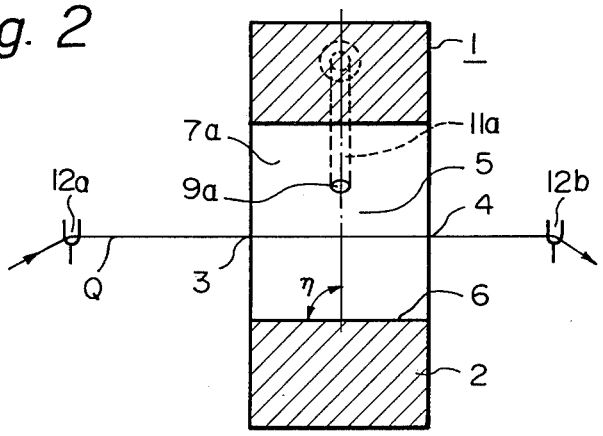
FIG. 2 is a cross sectional side view of the first embodiment illustrated in FIG. 1.

FIGS. 1 and 2 are cross sectional elevational and cross sectional side views which are utilized to explain the first embodiment of the present invention and which are also utilized to explain the basic technical concept prevailing over the present invention, including not only the first embodiment but also other embodiments. Referring to FIGS. 1 and 2, a yarn treating apparatus 1 of the present invention comprises a shell body 2. The shell body 2 has a filament treating chamber 5 formed therein which is provided with an entrance 3 and an exit 4 (see FIG. 2). The chamber 5 is enclosed with: a first wall 6 and a second wall 7*ab*. The first wall 6 is formed on a plane extending along the axis (not shown) of the chamber 5 and has a predetermined width as illustrated in FIG. 1. In FIG. 1, the second wall 7*ab* comprises a pair of flat surfaces 7*a* and 7*b*. The lower ends of the flat sufaces 7*a* and 7*b* constituting the second wall 7*ab* are connected to the widthwise ends 8*a* and 8*b* of the first wall 6. The upper ends of the flat surfaces 7*a* and 7*b* are connected to each other at line M extending perpendicular to the sheet on which FIG. 1 is illustrated to form a chamber having an equilateral triangular shape because the lengths of the flat surfaces are equal. As a result, the chamber 5 is symmetrical with respect to an imaginary standard plane L which passes through the center 6*a* of the first wall 6 in a direction perpendicular to the first wall 6 and which extends along the axis of the chamber. The second wall 7*ab* constituted with two flat surfaces 7*a* and 7*b* is provided with two fluid jet nozzles 9*a* and 9*b* which are utilized to eject fluid jet for treating a yarn passing through the chamber. The fluid jet nozzles 9*a* and 9*b* are formed symmetrical with each other with respect to the imaginary standard plane L so that fluid jet flows F1 and F2 ejected from the fluid jet nozzles 9*a* and 9*b* are directed to the first wall 6 and are symmetrical with each other with respect to the imaginary standard plane L and meet with each other above the first wall 6 before they reach it. In addition, the fluid jet nozzles 9*a* and 9*b* are communicated with passages 11*a* and 11*b* for introducing fluid jet which are formed in the shell body 2 and which have openings 10*a* and 10*b* at the external surface of the shell body 2. Referring to FIG. 2, a guide 12*a* is located upstream of the entrance 3 and a guide 12*b* is located downstream of the exit 4.

A phenomenon in the chamber 5 will now be explained by way of example wherein the apparatus illustrated in FIGS. 1 and 2 is utilized and a yarn Q (FIG. 2) is delivered between the guides 12*a* and 12*b* through the chamber 5 of the apparatus, into which air in a pressurized condition is ejected through the fluid jet nozzles 9*a* and 9*b* (FIG. 1) as a kind of fluid jet so that the yarn Q is subjected to a interlacing operation by flows F1 and F2 created by the fluid jet. In the apparatus 1, when pressurized air is introduced through the passages 11*a* and 11*b* for introducing fluid jet, the fluid jet flows F1 and F2 having the same energy therein are ejected into the chamber 6. They meet with each other at point K in FIG. 1 and gather together to form a resultant fluid jet flow F12. The fluid jet flow F12 advances along the imaginary standard plane L and impinges upon the first wall 6 to form a turbulent flow and then separates into two fluid flows FL and FR which advance along the first wall 6, as illustrated with arrows in FIG. 1. On the other hand, the yarn Q (FIG. 2) which is being delivered within the chamber 5 is conveyed to the point K by means of the fluid jet flow F1 or F2 and then is pressed upon the flat surface of the first wall 6. On the flat surface of the first wall 6, the yarn Q is subjected to the turbulent flow formed by impinging of the fluid jet flow F12, and then individual filaments constituting the yarn Q are separated from each other and are open. Since at the same time the individual filaments constituting the yarn Q move freely, the yarn is exposed to an interlacing condition, wherein the individual filaments intermingle randomly with each other, and as a result, an interlaced yarn wherein the individual filaments are securely interlaced is obtained. Thereafter the yarn Q which has been subjected to the interlacing operation follows either one of fluid flows FL or FR flowing along the flat surface of the first wall 6 and is moved to either the right or left portion on the flat surface of the first wall 6. After the yarn Q is moved to the end region of the first wall 6, it is raised along the flat surface 7*a* or 7*b* constituting the second wall 7*ab*. The yarn Q thus raised upwards is then conveyed again to the point K by means of the fluid jet flow F1 or F2, and the movement is periodically and stably repeated in the foregoing manner. The yarn Q thus obtained after it is delivered from the chamber 5 is highly interlaced.

It should be noted that the apparatus illustrated in FIGS. 1 and 2 is constructed in such a manner that the fluid jet flows F1 and F2 ejected from the fluid jet nozzles 9*a* and 9*b* are symmetrical with each other with respect to the imaginary standard plane perpendicular to the first wall 6 and that the energies in the fluid ejected from the two fluid jet nozzles 9*a* and 9*b* into the chamber 5 are equal. As a result, the fluid jet flow F12 lies on the imaginary standard plane L, and the intensities of the fluid flows FL and FR flowing horizontally along the first wall 6 are equal. Accordingly, the probability that the yarn Q is advanced toward the right portion or left portion on the first wall 6 after it has been subjected to the turbulent flow created by impinging of the fluid jet flow F12 upon the first wall 6 becomes $\frac{1}{2}$. In other words, the running yarn Q is not moved unidirectionally and continuously, and false-twists which may deteriorate the interlacing operation in the yarn are not imparted to the yarn.

In the apparatus illustrated in FIGS. 1 and 2, if the locations of the fluid jet nozzles 9*a* and 9*b* are moved downwards along the flat surfaces 7*a* and 7*b* or if the angle $\theta$ formed between the nozzle axis and the imaginary standard plane L is decreased, as the movement of the location of the point K where the axes of the fluid jet nozzle 9a and 9b meet with each other is also lowered, finally the location of the point K exceeds beyond the flat surface of the first wall 6 and does not exist within the chamber 5. Under such a condition, since the fluid jet flow F12 resulted by the fluid jet flows F1 and F2 does not exist, the yarn Q is not intermingled while it is directly pressed upon the flat surface of the first wall 6. As a result, the interlacing effect is highly decreased. However, it should be noted that the fluid jet flows F1 and F2 ejected from the fluid jet nozzles 9a and 9b have a certain amount of cross sectional area. Accordingly, at a point K' where prolongations extended from upper inner surfaces M1 and M2 of the fluid jet nozzles 9a and 9b which surfaces are the farthest from the first wall 6 is located on or above the flat surface of the first wall 6, there is a function that the fluid jet flows F12 presses the yarn Q upon the first wall 6. It is necessary that at least the point K' which has been defined above is located within the chamber 5 of the apparatus according to the present invention.

When the apparatus is constructed in the above explained manner, the fluid jet flows F1 and F2 ejected from the fluid jet nozzles 9a and 9b gather together to form the resultant fluid jet flow F12. After the fluid jet flow F12 has impinged upon the first wall 6, almost all of the fluid jet F12 flows axially along the first wall 6 to the entrance 3 and the exit 4 where it is discharged outwards. In other words, after the fluid jet flows F1 and F2 have impinged upon the first wall 6, a very little amount of fluid which is reflected from the first wall and which flows towards the top corner M of the chamber 5 appears at this point if the amount is compared with that ejected from the fluid jet nozzles 9a and 9b. In short, the efficiency of the fluid utilization for interlacing is considerably high. In conclusion, if the point K' is located within the chamber 5, the yarn Q is pressed upon the first wall 6 and is subjected to a high interlacing operation of the fluid jet.

It is preferable that the angle $\theta$ formed between the axis of the fluid jet nozzle 9a or 9b and the imaginary standard plane L is between 5° and 75°, and desirably between 20° and 50°.

The above-explained basic technical concept of the construction regarding the apparatus according to the present invention is also applicable to other various embodiments according to the present invention. However, in the following explanation regarding the various embodiments, the explanation of the basic technical concept is omitted, and characteristics of the embodiments only will be explained in detail. It should be noted that the above-explained basic technical concept is also applicable to an apparatus having chambers which have different cross sections, from the triangular shape illustrated in FIG. 1, such as a four-cornered shape, a pentagonal shape, a semicircular shape and a combination thereof.

Figure 3:
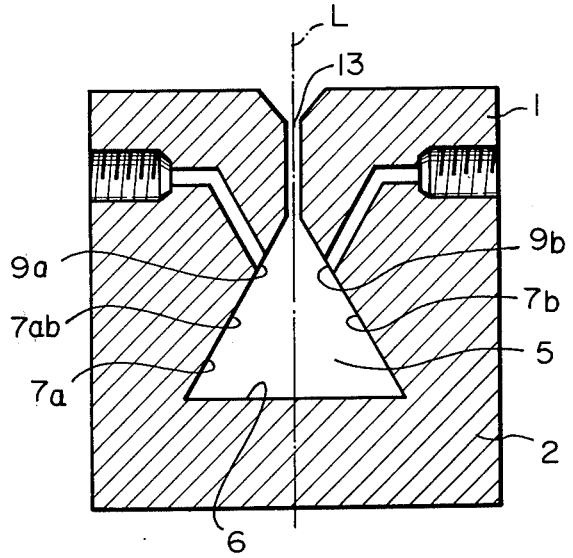
FIG. 3 is a cross sectional elevational view of a second embodiment of the present invention, which view corresponds to FIG. 1.

FIG. 3 is a cross sectional elevational view of a second embodiment of the present invention. The second embodiment has an important difference from the first embodiment illustrated in FIGS. 1 and 2 in that it is provided with a string-up slit 13. The slit 13 is utilized for introducing a yarn Q therethrough into the chamber 5 upon the commencement of the yarn treating operation and for discharging the yarn Q therethrough from the chamber 5 upon the stoppage of the yarn treating operation.

The apparatus according to the present invention of a type which is provided with the string-up slit 13 is characterized in that the string-up slit is open to the second wall 7ab in a diamond shaped region C illustrated in FIG. 1 which is surrounded by four straight lines connecting the four points, M, M1, K' and M2 and in that the string-up slit 13 extends along the imaginary standard plane L. Because of such construction of the string-up slit, the apparatus of this type according to the present invention is distinguished from the conventional yarn treating apparatus having a string-up slit for introducing and discharging a yarn. In the apparatus of the present invention of the type which has a string-up slit, because of the specially designed string-up slit, the string-up does not adversely affect the stability of the movements of the fluid and yarn in the chamber. In other words, the stability of the movements of the fluid and yarn is maintained at a high level, and as a result, the creation of unidirectional and continuous rotation of the yarn which is being treated is minimized. Accordingly, the creation of false-twists in the yarn is also minimized.

It is preferable that the width of the string-up slit 13 be as small as possible if the yarn can be introduced and discharged therethrough. If the width of the string-up slit 13 is unnecessarily wide, the movements of the yarn and fluid in the chamber 5 may be disturbed. Therefore, a string-up slit 13 having an excessive width must be avoided.

In the first embodiment of the present invention illustrated in FIGS. 1 and 2, the fluid jet nozzles 9a and 9b are so arranged that fluid jets ejected from said fluid jet nozzles 9a and 9b impinge perpendicularly upon the first wall 6 in the imaginary standard plane L; in other words the imaginary plane on which the axes of the fluid jet nozzles 9a and 9b lie and the first wall 6 form angle $\eta$ which is equal to a right angle as illustrated in FIG. 2. Alterations of the present invention regarding the angle $\eta$ which is formed between imagingary plane on which the axes of the fluid jet nozzles 9a and 9b lie and the first wall 6 will be explained hereinbelow.

Figure 4:
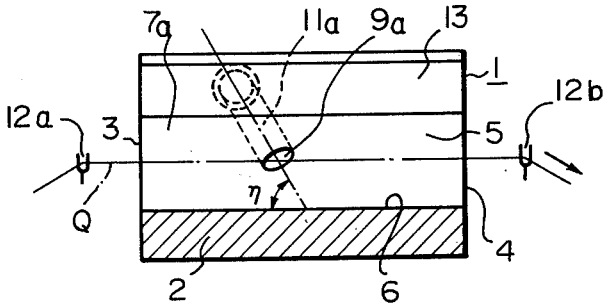
FIG. 4 is a cross sectional side view, taken along a plane extending along the axis, wherein a third embodiment of the present invention is illustrated.
Figure 5:
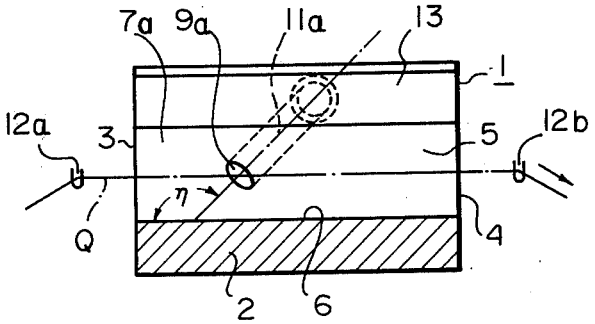
FIG. 5 is a cross sectional view of a fourth embodiment of the present invention.

In the third embodiment illustrated in FIG. 4, the angle $\theta$ is an acute angle. In this embodiment, after the fluid jet flows ejected from the fluid jet nozzles 9a (9b is not illustrated in FIG. 4) has pressed the yarn Q to the first wall 6, they advance along the axis of the chamber 5 and they are discharged from the exit 4. As a result, the stability of the fluid motion within the chamber 5 is enhanced. In the fourth embodiment illustrated in FIG. 5, the angle $\eta$ is an obtuse angle.

Figure 6:
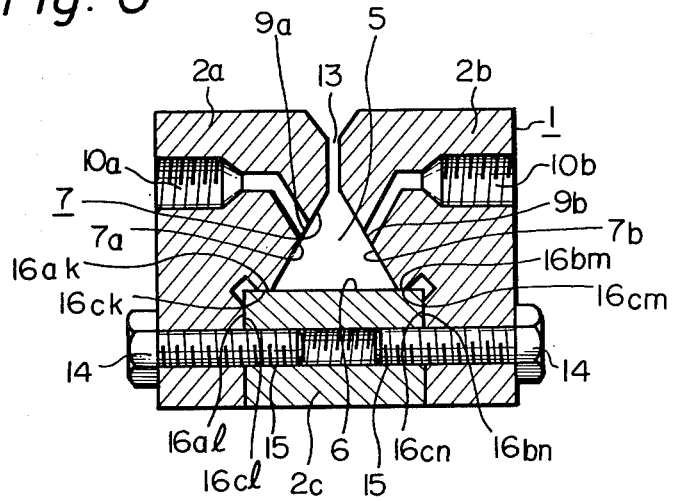
FIG. 6 is a cross sectional elevational view of a fifth embodiment of the present invention.

FIG. 6 is a cross sectional elevational view of the fifth embodiment of the present invention which is an alteration of the second embodiment illustrated in FIG. 3 and which is assembled so that the apparatus is simple in design, easy to manufacture, assemble, disassemble and repair. Referring to FIG. 6, the yarn treating apparatus 1 comprises three housing members 2a, 2b and 2c. The housing members 2a and 2b are symmetrical with each other and serve as second wall pieces for forming the second wall 7, and they have flat surfaces 7a and 7b obliquely formed thereon, respectively, and engaging surfaces 16ck and 16cl, and 16cm and 16cn of a shoulder type connected to the lower end of the flat surfaces 7a and 7b, respectively. The housing member 2c serves as a first wall piece having the first wall 6 thereon and has a rectangular cross section and engaging surfaces 16ak, 16al, 16bm and 16bn which engage with the engaging surfaces 16ck and 16cl, and 16cm and 16cn of the housing members 2a and 2b, respectively. The three housing members 2a, 2b and 2c are assembled and are fastened in one body by means of two screw bolts 14 which are threaded with female screws formed in the housing member 2c to form the chamber 5 having a triangular cross section and the string-up slit 13 between the housing members 2a and 2b. The housing members 2a and 2b serving as the second wall pieces have fluid jet nozzles 9a and 9b, respectively, which open at the flat surfaces 7a and 7b, respectively, constituting the second wall 7 of the chamber 5 and which are communicated with fluid supply ports 10a and 10b, respectively, where fluid is supplied from an external fluid supply source (not shown) so that fluid jet flows are ejected from the fluid jet nozzles 9a and 9b towards the first wall 6 formed on housing member 2c serving as the first wall piece. The string-up slit 13 is located on an imaginary bisector (not shown) of an angle formed by the two fluid jet nozzles 9a and 9b.

In the apparatus illustrated in FIG. 6, the interconnection between the housing members 2a and 2c is achieved by surface contact between the engaging surfaces 16ak and 16ck, and 16al and 16cl which are in abutment with each other. The surface contact extends along the axis of the chamber which is perpendicular to the sheet on which FIG. 6 is illustrated, and therefore, the housing members 2a and 2c are sealedly connected to each other in a precise locational relationship. Similarly the housing members 2b and 2c are also interconnected to each other by means of surface contact between the engaging surfaces 16bm and 16cm, and 16bn and 16cn which are in abutment with each other, respectively. In short, the housing members 2a and 2b which have the fluid jet nozzles 9a and 9b, respectively, are securely located via the housing member 2c at a predetermined locational relationship by means of the positioning effect generated by the engaging surfaces 16cl through 16cn, and then they are fastened in one body by means of the bolts 14. If a predetermined gap is formed between the facing surfaces of the housing members 2a and 2b, the gap forms the string-up slit 13 through which a yarn (not shown in FIG. 6) to be treated can be introduced into the chamber 5 or discharged from the chamber 5.

Figure 7:
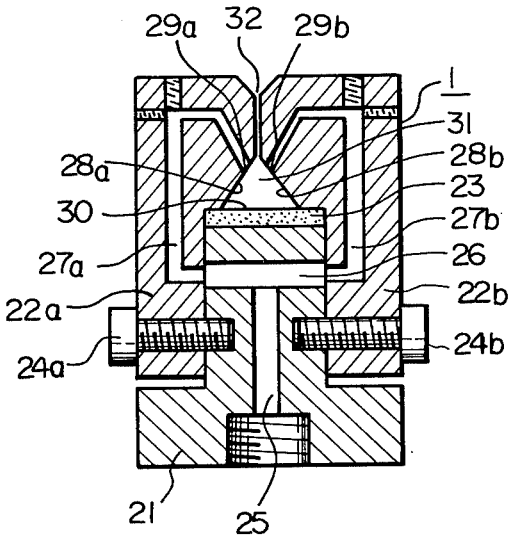
FIG. 7 is a cross sectional elevational view of a sixth embodiment of the present invention.

FIG. 7 is a cross sectional elevational view of the sixth embodiment of the present invention wherein an alteration of the assembled apparatus is illustrated. The characteristics of this embodiment are that the apparatus is of an assembled type and that the first wall formed on the first wall piece is made of ceramic. More specifically, the apparatus 1 comprises three housing members 21, 22a and 22b made of metal, such as brass, steel or stainless steel, a ceramic piece 23 and bolts 24a and 24b for fastening them. The housing member 21 has a reverse T-shaped cross section and a vertical passage 25 for introducing fluid formed at the center of the reverse T-shape and vertically extending upwards. A horizontal branch passage 26 is formed in the upper portion of the housing member 21 so that it crosses the vertical passage 25 and horizontally branches fluid supplied from the vertical passage 25. The housing members 22a and 22b are symmetrical with each other and have passages 27a and 27b for introducing fluid formed therein, respectively, which communicate with the horizontal branch passage 26 formed in the housing member 21 when the housing members 21, 22a and 22b are assembled together. The ends of the fluid introducing passages 27a and 27b open at the flat surfaces 28a and 28b which form the second wall so as to from fluid jet nozzles 29a and 29b. On the top of the reverse T-shaped housing member 21 is mounted the ceramic piece 23 the upper surface 30 of which forms a first wall. A chamber 31 is formed as a space surrounded by the upper surface 30 of the ceramic piece 23 and the flat surfaces 28a and 28b of the housing members 22a and 22b. A string-up slit 32 for introducing a yarn into the chamber 31 and discharging a yarn from the chamber 31 is formed as a gap formed between the housing members 22a and 22b when they are assembled.

Because the upper surface 30 serving as the first wall in this embodiment is formed on the ceramic piece 23, there is an advantage in that the first wall, which receives more abrasive force than the second wall, is durable against the abrasion caused by the effect of the energy in the fluid jet flows ejected from the fluid jet nozzles 29a and 29b and by the movement of the yarn. On the other hand, because the flat surfaces 28a and 28b of the second wall provided with the fluid jet nozzles 29a and 29b are made of metal, the fluid jet nozzles 29a and 29b can be precisely formed.

Figure 8:
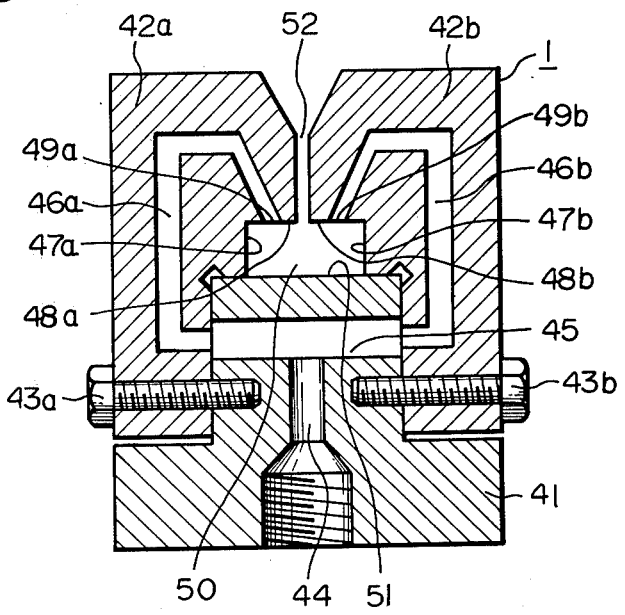
FIG. 8 is a cross sectional elevational view of a seventh embodiment of the present invention.

FIG. 8 is a cross sectional elevational view of the seventh embodiment of the present invention which is a further alteration of an assembled type apparatus. The characteristics of the apparatus are that the apparatus is of an assembled type and that the cross section of the chamber is a four-cornered shape rather than the triangular shape in FIG. 6. The apparatus 1 comprises three housing members 41, 42a and 42b and bolts 43a and 43b for assemblying them together. The housing member 41 has a reverse T-shaped cross section, and it has a vertical passage 44 for introducing fluid vertically formed upwards at the central portion of the reverse T-shaped cross section and a horizontal branch passage 45 connected to the upper end of the vertical passage 44 and formed in the T-shaped housing member 41. The housing members 42a and 42b are symmetrical with each other and have fluid introducing passage 46a and 46b formed therein, respectively, which communicate with the horizontal branch passage 45 when the housing members 41, 42a and 42b are assembled together. The ends of the fluid introducing passages 46a and 46b open at the inner upper surfaces 48a and 48b, respectively, which together with vertical surfaces 47a and 47b form the second wall, so that fluid jet nozzles 49a and 49b, are formed. The chamber 50 is formed as a space which is surrounded by a top surface 51 of the housing member 41 which surface serves as the first wall, and the surfaces 47a, 48a, 48b, 47b which serve as the second wall, and the chamber has a rectangular cross section. A string-up slit 52 for introducing a yarn into the chamber 50 and discharging the yarn therefrom is formed as a gap which is formed between the housing members 42a and 42b when they are assembled together.

Figure 9:
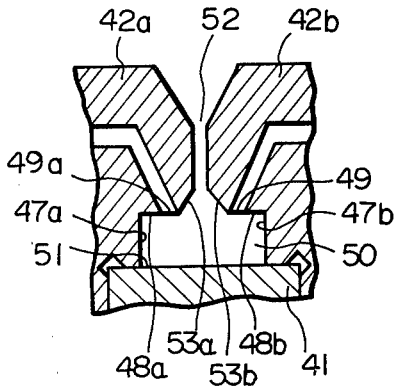
FIG. 9 is a cross sectional elevational view of a part of an eighth embodiment of the present invention.

FIG. 9 is a cross sectional elevational view of a part of an eighth embodiment wherein the shape of the second wall is slightly altered from that illustrated in FIG. 8. In the apparatus, the spring-up slit 52 is spread out as designated by reference numerals 53a and 53b at the surfaces 48a and 48b serving as the second wall by chamfering the edge of the surfaces 48a and 48b. The chamfered spread out portions 53a and 53b of the string-up slit 52 are used as guide surfaces for a yarn which is discharged from the chamber 50 so that the discharge of the yarn can be done easily.

Figure 10:
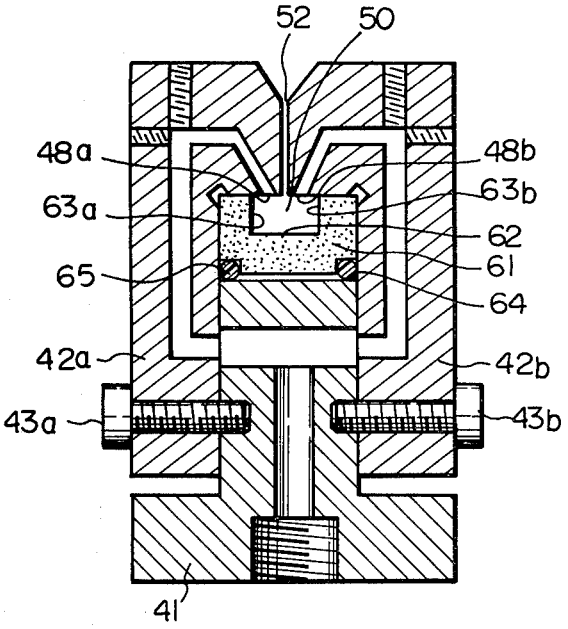
FIG. 10 is a cross sectional elevational view of a ninth embodiment of the present invention.

FIG. 10 is a cross sectional elevational view of a ninth embodiment which is still further alteration of the assembled type apparatus. The apparatus is distinguished from that illustrated in FIG. 8 by the fact that the first wall and a part of the second wall are made of ceramic. More specifically, a ceramic piece 61 of a square-prism has a groove with a four-cornered cross section which is formed thereon and the upper surface of which is open. The horizontal bottom surface 62 of the groove forms a first wall, and the vertical side surfaces 63*a* and 63*b* of the groove form a part of the second wall. The remaining part of the second wall is formed by the surfaces 48*a* and 48*b* formed on the housing members 42*a* and 42*b*. The ceramic piece 61 is supported on the top surface 64 of the housing member 41 via O-ring 65 made of an elastic material, such as natural or synthetic rubber. When the housing members 41, 42*a* and 42*b* are assembled and fastened together by means of the bolts 43*a* and 43*b*, the chamber 50 is formed as a space surrounded by the surfaces 62, 63*a*, 48*a*, 48*b* and 63*b*. At the same time between the housing members 42*a* and 42*b* is formed a gap which serves as a string-up slit 52 for introducing a yarn into the chamber 50 and discharging the yarn therefrom. Because the ceramic piece 61 is used, the apparatus as well as that illustrated in FIG. 7 has an advantage in that the durability of the apparatus is increased, since the surface 62 serving as the first wall and being in contact with fluid jet flows and the movement of the yarn and the surfaces 63*a* and 63*b* serving as a part of the second wall and connected to the surface 62 and located nearer than the fluid jet nozzles 49*a* and 49*b* are made of ceramic. On the other hand, since the surfaces 48*a* and 48*b* serving as the second wall where the fluid jet nozzles 49*a* and 49*b* open are made of a metal, the precision for manufacturing the fluid jet nozzles 49*a* and 49*b* are enhanced. The construction where the ceramic piece 61 is supported on the top surface of the housing member 41 via the elastic material 65 has an advantage in that the deflections in the parts caused when the parts are assembled are absorbed in the elastic material 65.

Figure 11:
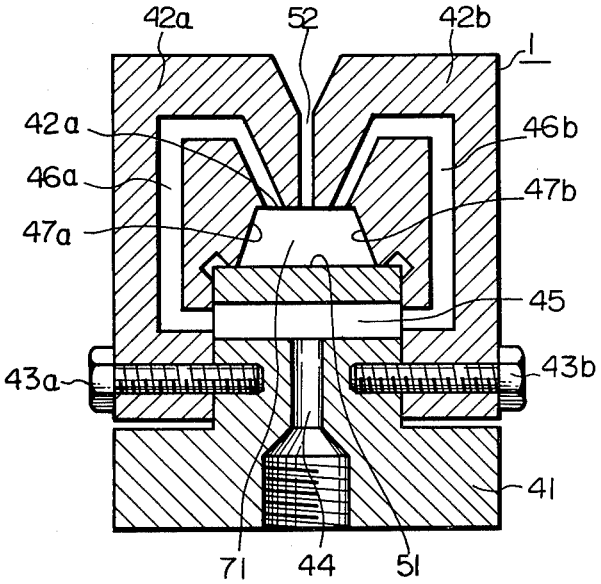
FIG. 11 is a cross sectional elevational view of a tenth embodiment of the present invention.

FIG. 11 is a cross-sectional elevational view of the tenth embodiment which is a still further alteration of an assembled type apparatus. The apparatus illustrated in FIG. 11 is characterized in that the chamber 71 has a trapezoidal cross section when it is compared with the apparatus illustrated in FIG. 8 wherein the chamber 50 has a rectangular cross section. The remaining parts in the apparatus in FIG. 11 are the same as those in FIG. 8, and therefore they are designated by the same reference numerals as those in FIG. 8 and their further explanation is omitted here.

Figure 12:
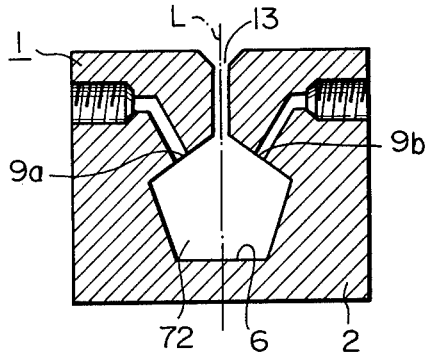
FIG. 12 is a cross sectional elevational view of an eleventh embodiment of the present invention.

FIG. 12 is a cross sectional elevational view of an eleventh embodiment. When the apparatus illustrated in FIG. 12 is compared with the apparatus illustrated in FIG. 3 wherein the chamber 5 has a triangular cross section, the apparatus illustrated in FIG. 12 is characterized in that the chamber 72 thereof has a pentagonal cross section. Since the remaining parts are the same as those in FIG. 3, they are designated with the same reference numerals and their further explanation is omitted here.

Figure 13:
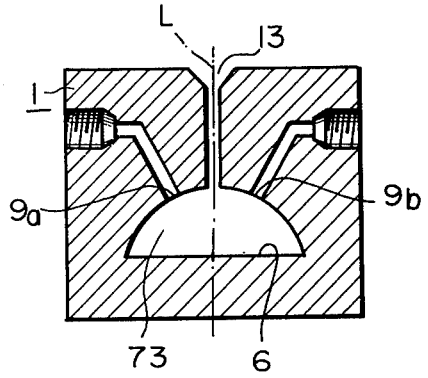
FIG. 13 is a cross sectional elevational view of a twelfth embodiment of the present invention.

FIG. 13 is a cross sectional elevational view of a twelfth embodiment. Compared with the chamber 5 having a tringular cross section in FIG. 3, the chamber 73 in the apparatus has a semicircular cross section. The remaining parts are the same as those in FIG. 3 and are designated with the same reference numerals, and therefore, their further explanation is omitted here.

Figure 14:
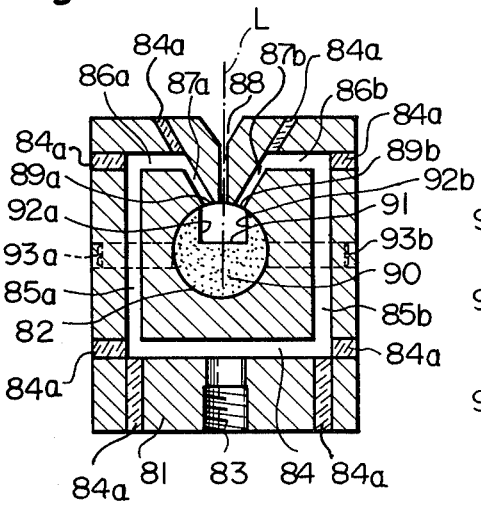
FIG. 14 is a cross sectional elevational view of a thirteenth embodiment of the present invention.
Figure 15:
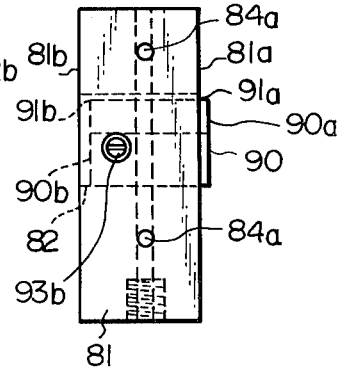
FIG. 15 is a side view of the embodiment illustrated in FIG. 14.

FIG. 14 is a cross sectional elevational view of a thirteenth embodiment, and FIG. 15 is a side view of the same. Although in the apparatus illustrated in FIG. 7 or 10, the ceramic piece 23 or 61 is assembled together with the housing members 21, 22*a* and 22*b*, or 41, 42*a* and 42*b* when they are assembled in one body, but in the apparatus illustrated in FIGS. 14 and 15, the housing 81 is formed by a single housing block made of a metal, such as brass, steel or stainless steel and cylindrical ceramic piece 90 having a first wall and a part of second wall formed thereon is detachably inserted into a cylindrical hole formed within the housing block 81.

More specifically, the housing block 81 has a cylinderical hole 82 formed therein and extending therethrough, for inserting the ceramic piece 90. Fluid introducing passages 83, 84, 85*a*, 85*b*, 86*a*, 86*b*, 87*a* and 87*b* are formed in the housing block 81, and one end of the passage 83 opens to the bottom surface of the housing block 81 and the ends of the passages 87*a* and 87*b* open to the cylindrical hole 82 for inserted the ceramic piece 90 to form fluid jet nozzles 89*a* and 89*b*. Plugs 84*a* are tightly inserted into the end portions of the passages 84, 85*a*, 86*a*, 87*a*, 85*b*, 86*b*, 87*b* so as to form continuous passages communicating the passage 83 with the fluid jet nozzles 89*a* and 89*b*. A string-up slit 88 is formed along the imaginary standard plane L sandwiched by the fluid jet nozzles 89*a* and 89*b*, and the upper end of the string-up slit 88 opens at the upper surface of the housing block 81 and the lower end of the string-up slit 88 opens to the cylindrical hole 82. The ceramic piece 90 which is detachably inserted into the cylindrical hole 82 has a groove opening upwards and extending along the axis of the ceramic piece, which axis is perpendicular to the sheet on which FIG. 14 is illustrated. The bottom surface 91 of the groove serves as a first wall, and the side surfaces 92*a* and 92*b* of the groove serves as a part of a second wall. After the ceramic piece 90 is inserted into the cylindrical hole 82, it is secured by machine screws 93*a* and 93*b* so that the opening of the groove formed on the ceramic piece 90 is located at a position were the fluid jet nozzles 89*a* and 89*b* and the string-up slit 88 open and so that the basic technical concept of the present invention which has been explained with reference to FIGS. 1 and 2 is satisfied. The apparatus has a characteristic in that the replacement of the ceramic piece 90 with a new one can be effected with ease. It is preferable that the lateral side surfaces 90*a* and 90*b* of the ceramic piece 90 are axially displaced a slight distance from the side surfaces 81*a* and 81*b* of the housing block 81 are illustrated in FIG. 15 rather than being aligned with each other. Because of such a construction, the yarn does not encroach into the small gap between the engaging surfaces of the ceramic piece 90 and the cylindrical hole 82 in the housing block 81. When the edges 91*a* and 91*b* of the ceramic piece 90 and the housing block 81 located on the engaging surfaces are sharp, the encroachment of a yarn is prevented more effectively.

Figure 16:
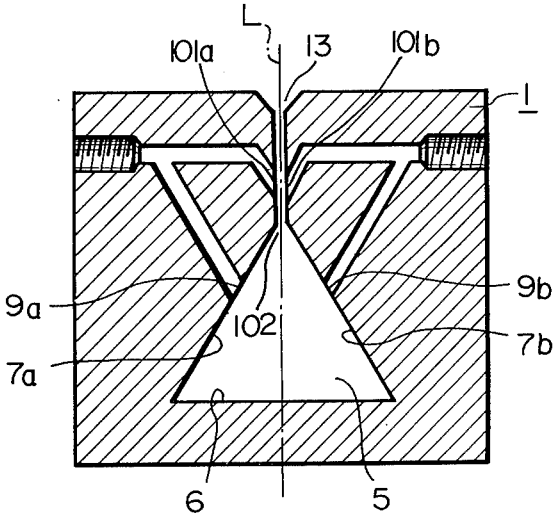
FIG. 16 is a cross sectional elevational view of a fourteenth embodiment of the present invention.

FIG. 16 is a cross sectional view of a fourteenth embodiment of the present invention. The apparatus illustrated in FIG. 3 has two fluid jet nozzles 9*a* and 9*b*, and the apparatus illustrated in FIG. 16 is provided with a further fluid jet nozzle 102 in addition to the fluid jet nozzles 9*a* and 9*b*, and accordingly the apparatus in FIG. 16 is provided with three fluid jet nozzles 9*a*, 9*b* and 102. The additional fluid jet nozzle 102 is connected to two sub-nozzles 101*a* and 101*b* opening into the string-up slit 13 and is formed by utilizing a part of the string-up slit 13 extending along the imaginary standard plane L. The remaining parts are the same as those in FIG. 3 and are designated by the reference numerals the same as those in FIG. 3, and therefore their further explanation is omitted here.

With reference to some examples, examples of the dimensions in the actual apparatus according to the present invention, especially dimensions of the chamber, will be described hereinbelow. It should be noted that the dimensions should be arbitrarily selected at appropriate values based on yarn treating conditions, such as the kind of yarn to be treated, yarn speed, tension in the yarn and the pressure of fluid, taking into consideration the basic technical concept of the present invention.

EXAMPLE 1

Figure 17A:
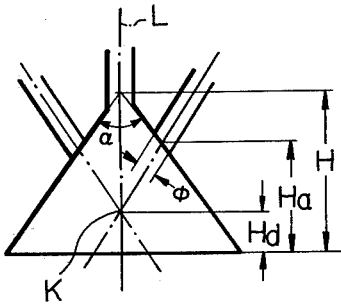
FIGS. 17*a* and 17*b* are diagrammatical elevational and side views which are utilized to explain the relationship of the size in the present invention.
Figure 17B:
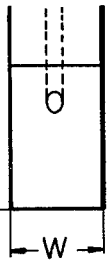

Yarn to be treated:
False twisted yarn of polyethylene terephthalate having a total denier of 150 denier and constituted with 48 filaments.
Yarn speed: 450 m/min
Tension in the yarn: 2 g
Fluid to be ejected:
Air with a pressure of 3 kg/cm$^2$ G
Shape of chamber:
Triangular cross section as illustrated in FIG. 17*a*
Main dimensions in the apparatus are as follows. (Note that the symbols are illustrated in FIGS. 17*a* and 17*b*.)

| TYPE | ANGLE α(deg) | DIAMETER φ(mm) | HEIGHT H(mm) | HEIGHT Ha(mm) | HEIGHT Hd(mm) | THICKNESS W(mm) |
|---|---|---|---|---|---|---|
| | 75 | 0.8 | 2.0 | 1.35 | 0.75 | 10 |
| 2 | 75 | 0.8 | 1.7 | 1.12 | 0.52 | 10 |

The distance between the guides 12*a* and 12*b* illustrated in FIG. 2 was appropriately adjusted in a range between 12 mm and 20 mm. The interlaced yarn thus obtained had no false twisted portions therein and was uniform and suitable in the interlacing density.

EXAMPLE 2

Figure 18A:
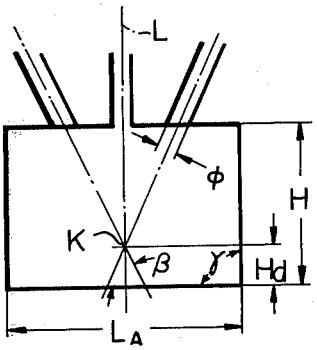
FIGS. 18*a* and 18*b* are also diagrammatical elevational and side views which are also utilized to explain the relationship of the size in the present invention.
Figure 18B:
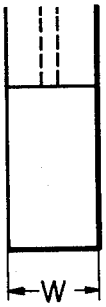

Yarn to be treated:
False twisted yarn of polyethylene terephthalate having a total denier of 150 denier and constituted with 48 filaments
Yarn speed: 450 m/min
Tension in the yarn: 2 g
Fluid to be ejected:
Air with a pressure of 3 kg/cm$^2$ G
Shape of chamber:
Rectangular cross section as illustrated in FIG. 18*a*
Main dimensions in the apparatus are as follows. (Note that the symbols are illustrated in FIGS. 18*a* and 18*b*.)

| TYPE | ANGLE β(deg) | DIAMETER φ(mm) | HEIGHT H(mm) | HEIGHT Hd(mm) | WIDTH LA(mm) | ANGLE γ(deg) | THICKNESS W(mm) |
|---|---|---|---|---|---|---|---|
| 3 | 60 | 0.9 | 1.3 | 0.33 | 2.3 | 90 | 10 |

The distance between the guides 12*a* and 12*b* illustrated in FIG. 2 was appropriately adjusted in a range between 12 mm and 20 mm. the interlaced yarn thus obtained had no false twisted portions therein and was uniform and suitable in the interlacing density.

EXAMPLE 3

Yarn to be treated:
Nylon flat yarn having a total denier of 70 denier and constituted with 12 filaments
Yarn speed: 870 m/min
Tension in the yarn: 2 g
Fluid to be ejected:
Air with a pressure of 2 kg/cm$^2$ G
Shape of chamber:
Rectangular cross section as illustrated in FIG. 18*a*
Main dimensions in the apparatus are as follows. (Note that the symbols are illustrated in FIGS. 18*a* and 18*b*.)

| TYPE | ANGLE β(de) | DIAMETER φ(m) | HEIGHT H(mm) | HEIGHT Hd(mm) | WIDTH LA(mm) | ANGLE γ(deg) | THICKNESS W(mm) |
|---|---|---|---|---|---|---|---|
| 4 | 70 | 0.8 | 1.5 | 0 | 2.5 | 90 | 10 |

The distance between the guides 12*a* and 12*b* illustrated in FIG. 2 was appropriately adjusted in a range between 50 mm and 200 mm. The interlaced yarn thus obtained had no false twisted portions therein and was uniform and suitable in the interlacing density.

What we claim is:

1. A yarn treating apparatus comprising a shell body which has: a yarn treating chamber formed therein; an entrance to said chamber formed at the front end thereof; an exit from said chamber formed at the rear end thereof; and jet nozzles for ejecting fluid jet formed on a peripheral wall of said chamber, which wall extends from said entrance to said exit, characterized in that:

(a) said peripheral wall of said chamber includes:
- a first wall which lies on a plane extending from said entrance to said exit along the axis of said chamber and which has a predetermined width in a direction perpendicular to said axis; and
- a second wall, the sides of which are connected to the widthwise sides of said first wall so that said chamber is substantially enclosed with said first and second walls, (b) said second wall is symmetrical with respect to an imaginary standard plane which passes through the center of said width on said first wall in a direction perpendicular to said first wall and which extends along said axis of said chamber;

(c) at least two fluid jet nozzles are formed on said second wall and are symmetrical with each other with respect to said imaginary standard plane;

(d) said fluid jet nozzles are constructed in such a manner that fluid jet flows ejected therefrom are directed to said first wall and are symmetrical with each other with respect to said imaginary standard plane and meet with each other at a position lowest on said first wall; and (e) said fluid jet nozzles are communicated with at least one passage for introducing fluid jet which is formed in said shell body and which is open to the outside of said shell body.

2. A yarn treating apparatus according to claim 1, wherein said second wall is constructed with a plurality of flat surfaces extending along said axis so that the cross section of said chamber, which is taken along a plane perpendicular to said axis, has a polygonal shape and so that said polygonal shape is symmetrical with respect said imaginary standar plane.

3. A yarn treating apparatus according to claim 2, wherein said chamber has a triangular cross section taken along said plane perpendicular to said axis.

4. A yarn treating apparatus according to claim 2, wherein said chamber has a four-cornered cross section taken along said plane perpendicular to said axis.

5. A yarn treating apparatus according to claim 4, wherein said chamber has a rectangular cross section taken along said plane perpendicular to said axis.

6. A yarn treating apparatus according to claim 4, wherein said chamber has a trapezoidal cross section taken along said plane perpendicular to said axis.

7. A yarn treating apparatus according to claim 2, wherein said chamber has a pentagonal cross section taken along said plane perpendicular to said axis.

8. A yarn treating apparatus according to claim 1, wherein said first wall has a chord section and second wall has an arch section, ends of which are connected to ends of said chord sections, so that said chamber forms a semi-circular cross section taken along said plane.

9. A yarn treating apparatus according to claim 1, wherein said second wall is constructed with a combination of at least one flat surface and at least one curved surface.

10. A yarn treating apparatus according to claim 1, which further comprises a string-up slit which extends along said imaginary standard plane and which communicates a surface of said second wall with the outside of said shell body.

11. A yarn treating apparatus according to claim 10, wherein said second wall communicating with said string-up slit is chamfered so that said string-up slit is spread out.

12. A yarn treating apparatus according to claim 10, wherein said shell body comprises: a first wall piece on which said first wall is formed; and at least two second wall pieces on which said second wall is formed, and wherein said first and second wall pieces are detachably assembled to form said chamber.

13. A yarn treating apparatus according to claim 12, wherein said first wall is made of ceramic.

14. A yarn treating apparatus according to claim 13, wherein regions on said second wall between portions where said fluid jet nozzles are located and portions where said second wall intersects with said first wall are made of ceramic.

15. A yarn treating apparatus according to claim 10, wherein said fluid jet nozzles are so arranged that an imaginary plane on which said fluid jet nozzles lie intersects with said first wall forming a right angle therebetween.

16. A yarn treating apparatus according to claim 10, wherein said fluid jet nozzles are so arranged that an imaginary plane on which said fluid jet nozzles lie intersect with said first wall forming an acute angle therebetween.

17. A yarn treating apparatus according to claim 1, which further comprises a ceramic piece which is detachable from said shell body, and said first wall is formed on said ceramic piece.

18. A yarn treating apparatus according to claim 17, wherein at least one of the surfaces of said entrance and said exit of said shell body is axially spaced a distance from the corresponding surface on said ceramic piece.

19. A yarn treating apparatus according to claim 17, wherein said ceramic piece has an engaging surface which engages with said second wall, and said ceramic piece is supported by an elastic member attached to a supporting surface opposite to said engaging surface.

* * * * *

UNITED STATES PATENT AND TRADEMARK OFFICE

CERTIFICATE OF CORRECTION

PATENT NO. : 4,251,904

DATED : February 24, 1981

INVENTOR(S) : Takao Sano; Masafumi Ogasawara

It is certified that error appears in the above—identified patent and that said Letters Patent is hereby corrected as shown below:

Column 1, line 37 - "1,301,500" should read --1,301,590--.

Column 4, line 46 - "embodimdent" should read --embodiment--.

Column 8, line 41 - "θ" should read --η--.

Column 9, line 67 - "from" should read --form--.

Column 10, line 29 - "assemblying" should read --assembling--.

Column 11, line 32 - "are" should read --is--.

In the table appearing in Column 13 after line 33, the digit --1-- should appear between "TYPE" and the digit "2".

Column 15, line 17 - "standar" should read --standard--.

Column 16, line 39 - "claim 17" should read --claim 13--.

Signed and Sealed this

Thirtieth Day of June 1981

[SEAL]

Attest:

RENE D. TEGTMEYER

Attesting Officer

Acting Commissioner of Patents and Trademarks